US005484553A

United States Patent [19]

Guth et al.

[11] Patent Number: 5,484,553

[45] Date of Patent: Jan. 16, 1996

[54] AQUEOUS, STORABLE WETTING AGENT WHICH IS LOW-FOAMING IN APPLICATION

[75] Inventors: Christian Guth, Birsfelden, Switzerland; Albert Stehlin, Rosenau, France

[73] Assignee: Ciba-Geigy Corporation, Ardsley, N.Y.

[21] Appl. No.: 163,612

[22] Filed: Dec. 8, 1993

Related U.S. Application Data

[63] Continuation of Ser. No. 47,887, Apr. 15, 1993, abandoned, which is a continuation of Ser. No. 586,094, Sep. 19, 1990, abandoned.

[30] Foreign Application Priority Data

Sep. 26, 1989 [CH] Switzerland ..... 3478/89

[51] Int. Cl.[6] ..... B01F 17/02; B01F 17/42

[52] U.S. Cl. ..... 252/351; 352/353; 352/174.21; 352/8.6

[58] Field of Search ..... 252/351, 353, 252/174.21, 8.6, 8.7, 8.9; 8/125, 127.1

[56] References Cited

U.S. PATENT DOCUMENTS

| | | | |
|---|---|---|---|
| 3,086,944 | 4/1963 | Wedell | 252/318 |
| 3,563,901 | 2/1971 | Crotty | 252/89.1 X |
| 3,684,723 | 8/1972 | Best et al. | 252/351 |
| 3,919,102 | 11/1975 | Kuhling et al. | 252/99 |
| 4,052,342 | 10/1977 | Fernley et al. | 252/541 OR |
| 4,129,515 | 12/1978 | Foster | 252/117 |
| 4,207,421 | 6/1980 | Scardera et al. | 252/351 X |
| 4,233,167 | 11/1980 | Sramek | 252/8.8 |
| 4,309,298 | 1/1982 | Adrian et al. | 252/95 |
| 4,321,052 | 3/1982 | Smerz et al. | 8/107 |
| 4,416,794 | 11/1983 | Barrat et al. | 252/174.21 |
| 4,443,270 | 4/1984 | Biard et al. | 252/174.21 X |
| 4,539,353 | 9/1985 | Abel et al. | 524/123 |
| 4,548,729 | 10/1985 | Schmid et al. | 252/174 |
| 4,668,423 | 5/1987 | Drozd et al. | 252/174 |
| 4,671,895 | 6/1987 | Erilli et al. | 252/174.21 X |
| 4,780,237 | 10/1988 | Schmid et al. | 252/174 |
| 4,784,798 | 11/1988 | Geke et al. | 252/174.21 X |
| 4,844,710 | 7/1989 | Guth et al. | 8/127.1 |
| 4,876,035 | 10/1989 | Breitzke et al. | 252/353 X |
| 4,973,423 | 11/1990 | Geke et al. | 252/174 |
| 4,988,462 | 1/1991 | Schepers et al. | 252/174.21 X |
| 5,013,327 | 5/1991 | Wahle et al. | 252/8.7 X |
| 5,035,814 | 7/1991 | Maaser | 252/8.7 |
| 5,080,831 | 1/1992 | Van Eenam | 252/558 |

FOREIGN PATENT DOCUMENTS

| | | |
|---|---|---|
| 1597176 | 7/1970 | France . |
| 1371770 | 10/1974 | United Kingdom . |
| 1566130 | 4/1980 | United Kingdom . |
| 1601652 | 11/1981 | United Kingdom . |
| 2152490 | 8/1985 | United Kingdom . |

OTHER PUBLICATIONS

93725j Chemical Abstract, vol. 79 (1973).
212843w Chemical Abstract, vol. 109 (1988).
201162j Chemical Abstract, vol. 112 (1990).

*Primary Examiner*—Richard D. Lovering
*Assistant Examiner*—Daniel S. Metzmaier
*Attorney, Agent, or Firm*—Kevin T. Mansfield

[57] ABSTRACT

An aqueous, storable wetting agent which is low-foaming in application and contains a nonionic surfactant selected from the group of the partially end group blocked alkoxylated fatty alcohols is described, which contains (a) 10 to 80% by weight of a nonionic surfactant of the general formula $$R-O\text{-}(\text{alkylene-O})_p\text{-}R_1 \quad (1)$$

in which R is an aliphatic radical of at least 8 carbon atoms, $R_1$ is hydrogen, $C_1$–to $C_8$alkyl, a cycloaliphatic radical of at least 5 carbons atoms, phenyl(lower)alkyl or styryl, "alkylene" is an alkylene radical of 2 to 4 carbon atoms and p is a number from 2 to 24 and (b) 1 to 10% by weight of a hydrotropic agent.

The novel wetting agent is used in the treatment of textiles, in particular in the pre-treatment.

6 Claims, No Drawings

AQUEOUS, STORABLE WETTING AGENT WHICH IS LOW-FOAMING IN APPLICATION

This application is a continuation of application Ser. No. 08/047,887, filed Apr. 15, 1993, abandoned, which application is a continuation of application Ser. No. 07/586,094, filed Sep. 19, 1990, abandoned.

The present invention relates to a novel aqueous, storable wetting agent which is low-foaming in application and to its preparation and use in the treatment of textiles.

It is known, for example, from DE-A 3,315,961 and 3,625,078 to use low-foaming wetting agents in the treatment of textiles, in order to improve their treatment in alkaline liquors. However, the wetting agents proposed for this purpose have a low cloud point, which has an unfavourable effect on their storage stability. At temperatures above the cloud point, phase separation occurs, as a result of which the use of these wetting agents is no longer possible.

The object of the present invention is to provide a wetting agent the cloud point of which ensures storage stability up to 40° C. and, at the same time, exhibits low-foaming behaviour in application.

The aqueous storable wetting agent according to the invention which is low-foaming in application and contains a nonionic surfactant selected from the group of the partially end group blocked alkoxylated fatty alcohols specifically contains (a) 10 to 80% by weight of a nonionic surfactant of the general formula $$R-O\text{-}(\text{alkylene-O})_p\text{-}R_1 \qquad (1)$$

in which R is an aliphatic radical of at least 8 carbon atoms, $R_1$ is hydrogen, $C_1$–to $C_8$alkyl, a cycloaliphatic radical of at least 5 carbon atoms, phenyl(lower)alkyl or styryl, "alkylene" is an alkylene radical of 2 to 4 carbon atoms and p is a number from 2 to 24 and (b) 1 to 10% by weight of a hydrotropic agent.

Substituent R in formula (1) is advantageously the hydrocarbon radical of an unsaturated or saturated aliphatic univalent alcohol of 8 to 22 carbon atoms. The hydrocarbon radical can be straight-chain or branched. R is preferably an alkyl or alkenyl radical of 9 to 14 carbon atoms.

Aliphatic saturated univalent alcohols can be natural alcohols, such as lauryl alcohol, myristyl alcohol, cetyl alcohol or stearyl alcohol, and synthetic alcohols, such as 2-ethylhexanol, 1,1,3,3-tetramethylbutanol, octan-2-ol, isononyl alcohol, trimethylhexanol, trimethylnonyl alcohol, decanol, $C_9$–$C_{11}$oxo alcohol, tridecyl alcohol, isotridecanol or linear primary alcohols (Alfols) of 8 to 18 carbon atoms. A few representatives of these Alfols are Alfol (8–10), Alfol (9–11), Alfol (10–14), (12–13) or Alfol (16–18). ("Alfol" is a registered trademark).

Examples of unsaturated aliphatic univalent alcohols are dodecenyl alcohol, hexanedecenyl alcohol or oleyl alcohol.

The alcohol radicals can be present individually or in the form of mixtures of two or several components, such as mixtures of alkyl and/or alkenyl groups derived from soya fatty acids, palm kernel fatty acids or tallow oils.

$(\text{Alkylene-O})_p$ chains are preferably of the ethylene glycol, ethylene propylene glycol or ethylene isopropylene glycol type; p is preferably 4 to 20.

Examples of nonionic surfactants are:

adducts of preferably 4 to 20 mol of alkylene oxides, in particular ethylene oxide, it being possible for individual ethylene oxide units to be replaced by substituted epoxides, such as isopropylene oxide and/or propylene oxide, with higher unsaturated or saturated fatty alcohols of 8 to 22 carbon atoms.

Nonionic surfactants of practical importance have the formula $$R-O\text{-}(CH_2-CH_2-O)_{n1}\text{-}(\underset{Y_1}{CH}-\underset{Y_2}{CH}-O)_{m1}\text{-}R_1, \qquad (2)$$

in which one of the radicals $Y_1$ and $Y_2$ is methyl or ethyl and the other is hydrogen, $n_1$ is an integer from 2 to 24 and $m_1$ is an integer from 0 to 15, the sum of $m_1$ and $n_1$ being at most 24 and R and $R_1$ being as defined in formula (1).

Of very particular interest are nonionic surfactants of the formula $$R_2-O\text{-}(CH_2-CH_2-O)_{n2}\text{-}(\underset{Y_3}{CH}-\underset{Y_4}{CH}-O)_{m2}\text{-}R_3, \qquad (3)$$

in which $R_2$ is $C_9$–to $C_{14}$alkyl, $R_3$ is hydrogen, butyl, a cycloaliphatic radical of at least 6 carbon atoms or benzyl, one of the radicals $Y_3$ and $Y_4$ is hydrogen or methyl and the other is hydrogen, $m_2$ is an integer from 0 to 8 and $n_2$ is an integer from 4 to 8.

Further important nonionic surfactants have the formula $$R_2-O\text{-}(CH_2-CH_2-O)_{n3}\text{-}(\underset{Y_5}{CH}-\underset{Y_6}{CH}-O)_{m3}\text{-}R_4, \qquad (4)$$

in which $R_2$ is as defined in formula (3), $R_4$ is hydrogen, $C_1$–to $C_4$alkyl or phenyl(lower)alkyl, one of the radicals $Y_5$ and $Y_6$ is hydrogen and the other is ethyl, $n_3$ is an integer from 4 to 8 and $m_3$ is an integer from 1 to 3.

The preparation of the nonionic surfactants of the formulae (1) to (4) is carried out in a manner known per se, for example by reacting the corresponding alkylene oxide adducts with thionyl chloride and subsequent reaction of the resulting chloro compound with a short-chain, cycloaliphatic fatty, phenyl(lower)alkyl or styryl alcohol.

The following compounds are suitable as component (b) of the composition according to the invention:

monovalent $C_4$–to $C_{18}$aliphatic and monocyclic alcohols, such as $C_2$–$C_{18}$alkanols, $C_2$–$C_{18}$alkenols and terpene alcohols, for example ethanol, propanol, isopropanol, hexanol, cis-3-hexen-1-ol, trans-2-hexen-1-ol, 1-octen-3-ol, heptanol, octanol, trans-2-cis-6-nonadien-1-ol, decanol, linanol, geraniol, dihydroterpinol, myrcenol, nopol and terpineol;

aromatic alcohols of the formula

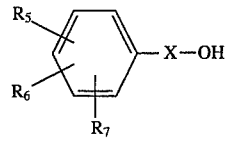

in which X is $-(CH_2)_{1-6}-$, $-CH=CH-CH_2-$ or $-O-(CH_2)_{2-6}-$ and $R_5$, $R_6$, $R_7$, independently of one another, are hydrogen, hydroxyl, halogen or $C_1$–$C_6$alkoxy, such as benzyl alcohol, 2,4-dichlorobenzyl alcohol, phenylethanol, phenoxyethanol, 1-phenoxy-2-propanol (phenoxyisopropanol) and cinnamyl alcohol;

sulfonates of terpenoids or mono- or binuclear aromatic compounds, for example sulfonates of camphor, toluene, xylene, cumene and naphthol;

aliphatic saturated and unsaturated $C_1$–$C_{11}$ monocarboxylic acids, such as acetic acid, propionic acid, caproic acid, undecylenic acid;

saturated or unsaturated $C_3$–$C_{12}$di- or polycarboxylic acids, for example malonic, succinic, glutaric, adipic, pimelic, suberic, azelaic and sebacic acid, undecanoic and dodecanoic dicarboxylic acid, fumaric, maleic, tartaric and malic acid and citric and aconitic acid.

All organic acids mentioned can also be present in the form of their water-soluble salts, such as the alkali metal salts, in particular the sodium or potassium salts, or the amine salts.

Particularly preferred hydrotropic agents according to the invention of component (b) are alkyl sulfates of the formula $$R_8O—SO_3X, \quad (5)$$

in which $R_8$ is an aliphatic saturated, branched or straight-chain radical of 4 to 24 carbon atoms and X is hydrogen, alkali metal or ammonium.

If the alkyl sulfate is present as a salt, examples of suitable salts are sodium, potassium or ammonium salts. The sodium salt is preferred.

Very particularly preferred hydrotropic agents of component (b) are alkyl sulfates in which the substituent $R_8$ in formula (5) is the hydrocarbon radical of an aliphatic saturated univalent alcohol of 4 to 24 carbon atoms. The hydrocarbon radical can be straight-chain or branched.

Examples of suitable aliphatic saturated univalent alcohols are natural alcohols, such as lauryl, myristyl, cetyl, stearyl, arachidyl or behenyl alcohol. Preference is given to compounds in which the substituent $R_8$ is derived from branched aliphatic synthetic alcohols of 4 to 12, in particular 4 to 8, carbon atoms, for example isobutyl alcohol, sec.-butanol, tert.-butanol, isoamyl alcohol, 2-ethylbutanol, 2-methylpentanol, 5-methylheptan-3-ol, 2-ethylhexanol, 1,1,3,3-tetramethylbutanol, octan-2-ol, isononyl alcohol, trimethylhexanol, trimethylnonyl alcohol, decanol or $C_9$–$C_{11}$oxo alcohol. The alkyl sulfates can already be present in the form of their salts and be used alone or as a (technical grade) mixture with one another in the wetting agent according to the invention.

Alkyl sulfonates and their alkali metal salts or amine salts can also be used as hydrotropic agents together with other compounds, for example with polymerised acrylic acid, $C_1$–to $C_{10}$alkylphosphonic acid or $C_1$–to $C_{10}$alkylphosphonic esters.

These alkyl sulfates are prepared in a manner known per se by reacting the corresponding alcohols with, for example, sulfuric acid, oleum, chlorosulfonic acid or sulfur trioxide.

The wetting agent according to the invention can additionally contain an optional component (c).

For this purpose, nonpolar organic solvents are suitable whose flash point is above 65° C. For example, cyclic straight-chain or in particular branched alcohols can be used, such as cyclohexanol, methylcyclohexanol, tetraline, n-hexanol, 2-ethylhexanol, isooctyl alcohol, isononyl alcohol and in particular 3,5,5-trimethylhexanol. Furthermore, esters, such as tributyl citrate or tributyl phosphate, can be used as unpolar organic solvents.

The novel wetting agents can be prepared by simply stirring the components mentioned (a), (b) and, if desired, (c).

The preparation is preferably carried out by mixing components (a), (b) and, if desired, (c) with stirring and adding deionised water until a homogeneous solution is obtained.

Preferred wetting agents according to the invention particularly advantageously contain, relative to the entire mixture, 15 to 60% by weight of component (a), 2 to 10% by weight of component (b), 0 to 4% by weight of component (c) and water to add up to 100 %.

The novel wetting agents are aqueous formulations which are low-foaming in application and are distinguished by a cloud point above 40° C. and storage stability up to 40° C.

They are used as wetting agents in the treatment of textiles, in particular in the pre-treatment, such as in the long-liquor bleaching or in the chlorine and peroxide hot bleaching.

Accordingly, the present invention also relates to a process for the wetting of fibre materials. In this process, these materials are treated in the presence of a wetting agent containing (a) 10 to 80% by weight of a nonionic surfactant of the general formula $$R—O\text{-}(\text{alkylene-O})_p\text{-}R_1 \quad (1)$$

in which R is an aliphatic radical of at least 8 carbon atoms, $R_1$ is hydrogen, $C_1$–to $C_8$alkyl, a cycloaliphatic radical of at least 5 carbon atoms, phenyl(lower)alkyl or styryl, "alkylene" is an alkylene radical of 2 to 4 carbon atoms and p is a number from 2 to 24 and (b) 1 to 10% by weight of a hydrotropic agent (c) 0 to 4% by weight of an unpolar solvent and water to add up to 100%.

The amounts of the wetting agent according to the invention which are added to the treatment liquors are between 0.1 and 10, preferably 0.5 and 5 g per liter of treatment liquor. The liquor can additionally contain further additives, for example desizing agents, dyes, fluorescent whitening agents, synthetic resins and alkalis such as sodium hydroxide.

Suitable fibre materials are as follows:

cellulose, in particular not pre-treated natural cellulose, such as hemp, linen, jute, staple viscose, filament viscose, acetate rayon, native cellulose fibre and in particular raw cotton, wool, polyamide, polyacrylonitrile and polyester fibre materials and mixed fibres, for example those made of polyacrylonitrile/cotton or polyester/cotton.

The fibre material to be treated can be present in a wide range of processing stages, for example with cellulose-containing material as loose material, yarn, woven fabric or knitted fabric. Thus, as a rule, they are always textile fibre materials which are made of pure textile cellulose fibres or of mixtures of textile cellulose fibres with textile synthetic fibres. The fibre material can be treated in the aqueous liquor continuously or batchwise.

The aqueous treatment liquors can be applied to the fibre materials in a known manner, advantageously by impregnation in the pad-mangle, where the liquor pick-up is about 50 to 120% by weight. The padding method is used in particular in the pad-steam process, the pad-thermofixing process and the pad-batch process.

The impregnation can be carded out at 10° to 60° C., but preferably at room temperature. After the cellulose material has been impregnated and squeezed off, it is subjected, if appropriate after drying it in between, to a heat treatment, for example at temperatures of 95° to 210° C. For example, the heat treatment after drying the material in between at 80° to 120° C., can be carded out by heat setting at a temperature of 120° to 210° C., preferably 140° to 180° C. Preferably, the heat treatment is carried out directly, i.e. without drying in between, by steaming at 95° to 120° C., preferably 100° to 106° C. Depending on how much heat is formed and the temperature range, the heat treatment can last 30 seconds to 30 minutes. In the pad-batch process, the impregnated material is rolled up without drying and then, if appropriate, wrapped in a plastic film, and stored at room temperature for 1 to 24 hours.

However, the treatment of the fibre materials can also be carried out in so-called long liquors at a liquor ratio of, for example, 3:1 to 100:1, preferably 8:1 to 25:1 and at 10 to 100, preferably 80° to 98° C., under standard conditions, i.e. under atmospheric pressure in conventional apparatuses, for example a jigger, a jet-dyeing machine or a winch for about ¼ to 3 hours. However, if appropriate, the treatment can also be carried out in so-called high-temperature apparatuses (HT apparatuses) under pressure up to 150° C., preferably 105° to 140° C.

If required by the process, the fibre materials are then rinsed thoroughly with hot water of about 90° to 98° C. and then with warm and finally with cold water, neutralized, if necessary, and then dried preferably at elevated temperatures.

Essential advantages of the wetting agents according to the invention are, in addition to their excellent wetting effect, their storage stability and their low-foaming behaviour in application.

In the examples which follow, the percentages are always by weight.

Preparation Examples of the Formulations

EXAMPLE 1

Formulations A, B, C and D are prepared by mixing the components listed in Table I according to their weight ratios with stirring until a homogeneous solution is formed.

TABLE I

| | A | B | C | D |
|---|---|---|---|---|
| Nonionic surfactant of the formula (I), for example 15 mol of the ethylene oxide/propylene oxide adduct with 1 mol of a $C_9$—$C_{11}$ fatty alcohol | 25 | 25 | 25 | 25 |
| Sodium 2-ethylhexyl sulfate (40% solution) | 9 | 9 | | |
| 3,5,5-Trimethylhexanol | | 3 | 2 | |
| Sodium cumene sulfonate 100% | | | 10 | 10 |
| Isopropanol | | | | 5 |
| Water | 66 | 63 | 63 | 60 |
| Cloud point [°C.]* | 40.5 | 41.5 | 45.3 | 55.5 |
| Foam height [ml] of 2 g/l of the formulation** | 70 | 50 | 50 | 80 |

*Cloud point of the formulation as such;
**Foam test in accordance with DIN 53902

Working Examples

EXAMPLE 2

A raw cotton knitted fabric is bleached in an ® AHIBA dyeing apparatus in a bath containing per liter 2 g of formulation B 0.2 g of the aqueous mixture of the oligomer mixture of phosphoric esters according to U.S. Pat. No. 4,254,063, sodium gluconate and magnesium chloride (ratio 2:1:1)

1 g of solid NaOH and 5 ml of $H_2O_2$ (35%).

The bleaching bath is heated to 90° C. over a period of 20 minutes and then kept at this temperature for another 30 minutes. The substratum is then washed with hot and cold water and neutralized. During the bleaching treatment, no troublesome foam formation takes place. The result is a uniform whiteness with an increase from −72 to 50 on the CIBAGEIGY whiteness scale.

EXAMPLE 3

A raw cotton knitted fabric having a weight per linear meter of 80 g is passed through a chlorine bleaching bath containing per liter 4 g of active chlorine 1.5 g of NaOH (100%) and 2 g of formulation B in a Galaxy apparatus (from Benninger, Switzerland) at a speed of 54 m/min.

The residence time is 15 minutes at 16° C.

The material is uniformly wetted and the chlorine bleaching bath is foam-free. After a rinsing step, the material is squeezed off and passed through a $H_2O_2$ bleaching bath containing per liter 2 g of the aqueous mixture of the oligomer mixture of phosphoric esters according to U.S. Pat. No. 4,254,063, sodium gluconate and magnesium chloride (ratio 2:1:1)

3 g of NaOH (100%)

3 ml of water glass 38° Bé

0.5 g of formulation B and 15 ml of $H_2O_2$ (35%).

The residence time is 35 minutes at 85° C. In the peroxide bleaching bath, too, no troublesome foam formation takes place. The result is a high uniform whiteness of R46=86.2 (measured by the Elrepho-apparatus).

What is claimed is:

1. An aqueous storable wetting agent which is low-foaming in application consisting essentially of (a) 10 to 80% by weight of a nonionic surfactant of the general formula $$R_2-O-(CH_2-CH_2-O)_{n3}-(\underset{Y_5}{CH}-\underset{Y_6}{CH}-O)_{m3}-R_4, \quad (4)$$

in which $R_2$ is $C_9$–to $C_{14}$alkyl, $R_4$ is hydrogen or $C_1$–to $C_4$alkyl, one of the radicals $Y_5$ and $Y_6$ is hydrogen and the other is ethyl, $n_3$ is an integer from 4 to 8 and $m_3$ is an integer from 1 to 3;

(b) 1 to 10% by weight of a hydrotropic agent selected from the group consisting of aromatic alcohols of the formula

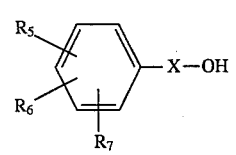

in which X is $-(CH_2)_{1-6}-$, $-CH=CH-CH_2-$ or $-O-(CH_2)_{2-6}-$ and $R_5$, $R_6$ and $R_7$, independently of one another, are hydrogen, hydroxyl, halogen or $C_1$–$C_6$alkoxy; and alkyl sulfates of the formula $$R_8O-SO_3X, \quad (5)$$

in which $R_8$ is an aliphatic, saturated, branched or straight-chain radical of 4 to 24 carbon atoms and X is hydrogen, an alkali metal or ammonium;

(c) 0 to 4% by weight of an nonpolar organic solvent; and (d) water to add up 100%.

2. A wetting agent according to claim 1, wherein, in the nonionic surfactant of the general formula (4), $R_4$ is hydrogen or $C_1$–to $C_4$alkyl and $m_3$ is 1.

3. A wetting agent according to claim 1, wherein the hydrotropic agent in component (b) is an alkyl sulfate of the formula $$R_8O—SO_3X, \quad (5)$$

in which $R_8$ is an aliphatic saturated, branched or straight-chain radical of 4 to 24 carbon atoms and X is hydrogen, an alkali metal or ammonium.

4. A wetting agent according to claim 1, wherein $R_8$ is an aliphatic branched radical of 4 to 12 carbon atoms.

5. A wetting agent according to claim 1, wherein $R_8$ is an aliphatic branched radical of 4 to 8 carbon atoms.

6. A wetting agent according to claim 1, which contains, relative to the agent, (a) 15 to 60% by weight of component (a), (b) 2 to 10% by weight of component (b), (c) 0 to 4% by weight of component (c) and water to add up to 100%.

* * * * *